United States Patent [19]

Wingate-Hill et al.

[11] Patent Number: 4,875,511

[45] Date of Patent: Oct. 24, 1989

[54] APPARATUS FOR REMOVING BARK FROM LOGS

[75] Inventors: Robin Wingate-Hill, Curtin; Bernard M. Hadaway, Highett, both of Australia

[73] Assignee: Commonwealth Scientific and Industrial Research Organisation, Australia

[21] Appl. No.: 131,485

[22] Filed: Dec. 10, 1987

[30] Foreign Application Priority Data

Dec. 10, 1986 [AU] Australia ..... PH9431
Oct. 20, 1987 [AU] Australia ..... PI4967

[51] Int. Cl.[4] ..... B27L 1/00; B27M 1/02

[52] U.S. Cl. ..... 144/208 R; 100/89; 100/158 R; 144/208 F; 144/362

[58] Field of Search ..... 100/89, 158; 144/208 R, 144/208 F, 362

[56] References Cited

U.S. PATENT DOCUMENTS 2,945,523 7/1960 Jenkins ..... 144/208 F
3,263,720 8/1966 Brock et al. ..... 144/208 F
3,587,685 6/1971 Morey ..... 144/208 F

FOREIGN PATENT DOCUMENTS 77559 10/1958 Norway ..... 144/208 F

*Primary Examiner*—W. Donald Bray
*Attorney, Agent, or Firm*—Sughrue, Mion, Zinn, Macpeak and Seas

[57] ABSTRACT

Apparatus for removing bark from logs, particularly from logs of stringy-bark eucalyts and other rough-barked tree species, and for crushing logs, consists of a plurality of pairs of concave rollers which are mounted in spaced-apart relationship along the linear passage of the log through the apparatus. Each pair of concave rollers applies pressure to regions of the log to loosen the bark from the body of the log. Knives may be included on the concave surfaces of some or all of the rollers to cut the loosened bark.

7 Claims, 1 Drawing Sheet

FIG. 1
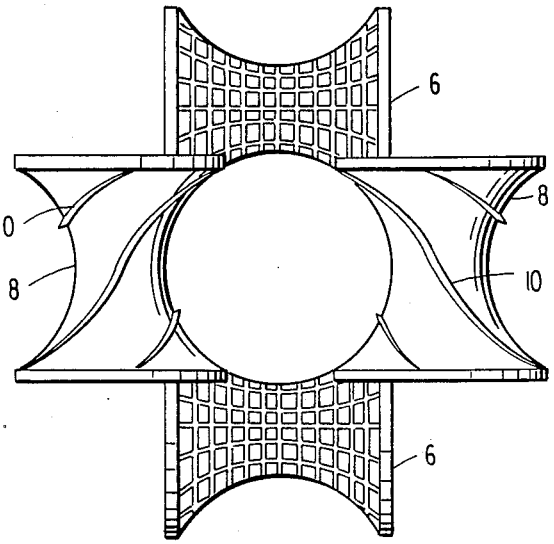
FIG. 2
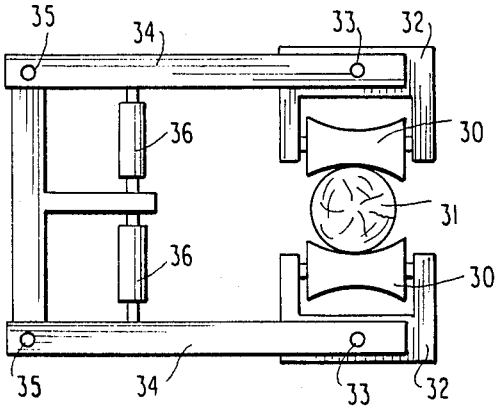
FIG. 3
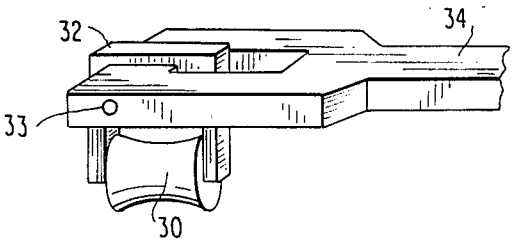
FIG. 4 (a)
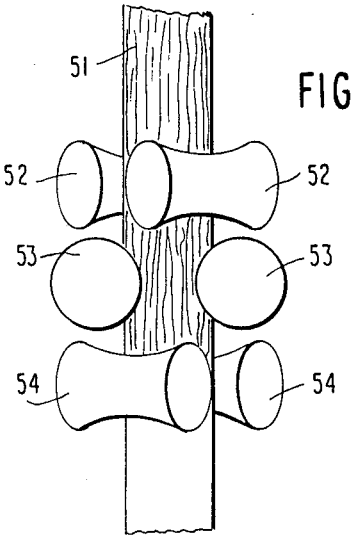
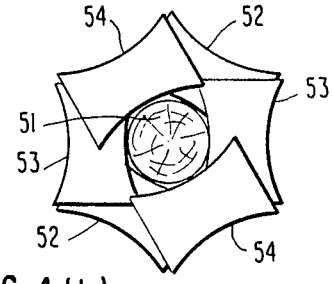
FIG. 4 (b)

APPARATUS FOR REMOVING BARK FROM LOGS

TECHNICAL FIELD

This invention concerns the removal of bark from logs, and more particularly concerns apparatus for the debarking of logs which uses a plurality of rollers bearing against the log.

BACKGROUND

The removal of bark from logs has been termed both "log barking" and "log debarking". The present inventors prefer the term "log debarking".

Log debarking techniques have been described, in general terms, in the August 1969 issue of the Australian Timber Journal, pages 43 and 45, in the book entitled "Handbook of Pulp and Paper Technology" (second edition), edited by K.W. Britt and published by Van Nostrand Reinhold Company, at pages 103 and 122, and also in the book entitled "Forest Products, their Sources, Production and Utilization", by Panshin, Harrer, Bethel and Baker, published by McGraw-Hill Book Company (second edition, 1962), at pages 332 to 335.

As will be seen from these references, it has been common practice to use a drum debarker to remove bark from logs. With a drum debarker, logs are passed through a rotating drum which has internal vanes or ribs. As the logs are tumbled within the drum, they strike each other and the vanes or ribs within the drum, and these impacts act to tear the bark from the logs.

Such drum debarkers are generally unsuitable for debarking stringy-bark eucalypts and other rough barked species. Rotary or ring debarkers have been used for this application, but with limited success. The rotary or ring debarkers have a hollow rotor unit within which are mounted inwardly projecting cutters or barking tools. The cutters or barking tools are rotated about a log as it is moved through the rotor unit to cut and strip the bark from the logs. Examples of developments in rotary debarkers are found in the specifications of Australian patents Nos. 479,105 (to Kokum Industri Aktiebolag) and 501,776 (to V.L. Valo), and in the specifications of Australian patent applications Nos. 21267/83 (Hutson) and 66304/86 (Fuji Kogyo K K).

Other debarking techniques include hydraulic debarkers using water jets under high pressure, flails (see the specification of Australian patent No. 506,204 to L.J. Emmins), "knocking" the bark from a log (see the specification of Australian patent No. 511,333 to G.A. Williames), and, of course, manual removal of the bark with axes and the like.

All of these prior art bark removal techniques and equipment have been recognised as not being entirely satisfactory, because the technique used is too slow, or too expensive, or is not really effective at stripping the bark cleanly from the wooden body of a log.

DISCLOSURE OF THE PRESENT INVENTION

It is an object of the present invention to provide apparatus which will effectively and rapidly remove bark from relatively small diameter logs — including logs of the stringly-bark eucalyptus species.

This objective is achieved by providing apparatus having at least two pairs of rollers, each pair of rollers being adapted to apply pressure to a log passing between them. The rollers are mounted in the equipment with the axes of each pair of rollers substantially parallel to each other and laterally spaced relative to each other and at an angle relative to the axial direction of the rollers of the other pair or pairs of rollers. The outer surface of each roller is concave, and the pairs of rollers are mounted in spaced apart relationship along the path a log takes in the debarking equipment. A log to be de-barked is passed between the rollers of the first pair, then through the second pair of rollers and then (if there are more than two pairs of rollers) sequentially through the third and any subsequent pairs of rollers. The rollers of the first pair are grooved or provided with spikes or are otherwise roughened to provide a firm grip on a log. Each roller of at least the last pair of rollers encountered by the log is preferably provided with one or more knife blades on its concave surface, for cutting through loosened bark on the log.

In the simplest form of the present invention, two pairs of rollers are included in the debarking equipment. In this case, the axes of rotation of each set of rollers are substantially at right angles to the axes of rotation of the other set of rollers. The preferred form of the present invention, however, incorporates three pairs of rollers, mounted so that the axes of rotation of each pair of rollers are parallel to each other and are substantially at an angle of 60° relative to the axes of rotation of the other pairs of rollers. Preferably each pair of rollers in log debarking equipment which includes three or more pairs of rollers is provided with one or more knife blades mounted on its concave surface if a separate bark cutting arrangement is not provided with the debarking equipment.

The rollers are driven at a speed which can be varied to suit the conditions under which the debarking is being effected, and act to propel the log through the equipment without rotating the log about the log axis. At least one of the rollers in each pair of rollers will be resiliently mounted so that it can be pressed against the log with variable force, depending upon the tightness of the bark.

Thus according to the present invention, there is provided apparatus for removing the bark from logs which comprises (a) at least two pairs of rollers, each roller having a concave outer surface; the rollers of each pair of rollers being mounted with their axes of rotation parallel to each other and spaced apart laterally, and at an angle relative to the axes of rotation of the or each other pair of rollers; each pair of rollers defining an aperture through which a log may pass, each said aperture being located on a linear path for said log through the apparatus;

(b) means resiliently biasing at least one roller of each pair of rollers towards the other roller in its pair of rollers;

(c) means for rotating the rollers about their axes of rotation; and (d) means for cutting through the bark after or during the passage of the log between the pairs of rollers.

Preferably each roller of the first pair of rollers encountered by a log being debarked has a grooved or roughened surface or will otherwise be formed to grip a long and propel it through the debarking equipment.

When a log to be de-barked is fed into the apparatus and between the first pair of rollers, the first rollers apply a compressive force to the log to such an extent that the bond between the bark and the body of the log is broken and the bark separates from the timber body of the log, at least over the region of contact between the first rollers and the bark. It remains as a tube of enlarged cross-section around the timber body. If knife blades have been formed or mounted on any set of rollers, these blades cut the tubular bark into strips, which fall from the log.

Embodiments of the present invention will now be described, with reference to the accompanying drawings.

BRIEF DESCRIPTION OF THE DRAWINGS

FIG. 1 is a partly schematic end elevation (from the downstream end) of the roller assembly used in an embodiment of the present invention.

FIG. 2 illustrates, partly schematically, one mounting arrangement for a pair of rollers that may be used in the second aspect of the present invention.

FIG. 3 is a perspective sketch of the mounting used for a roller in the arrangement featured in FIG. 3.

FIG. 4(*a*) and (*b*) is a schematic diagram illustrating an embodiment of the second aspect of the present invention which incorporates three pairs of rollers.

DETAILED DESCRIPTION OF THE ILLUSTRATED EMBODIMENTS

A roller assembly for the simplest embodiment of the present invention is shown in FIG. 1. This embodiment comprises a first set of parallel compression rollers 6, and a second set of parallel compression and cutting rollers 8 which are mounted downstream of the first set of rollers and arranged with their axes substantially perpendicular to the rollers of the first set.

The rollers 6 of the first set of rollers are of concave rollers. The extent and shape of the concavity of the rollers may be changed to suit logs of different diameter. The surface of each roller should be grooved or otherwise roughened or provided with welded-on bars, spikes or the like for gripping the surface of a log being treated. As noted earlier in this specification, the first set of rollers 6 compresses the timber and bark to cause transverse elongation of the bark such that the bark remains as a tube of enlarged section around the body of the log, with the bark remaining attached to the timber at zones facing the centre sections of the two rollers 6. The rollers 8 of the second set are of similar profile to those of the first set and include one or more knife blades 10. The rollers 8 compress rotate at the same speed, but in opposite directions, and are biased one towards the other by means well known in the art such as pneumatic or hydraulic cylinders which are resiliently mounted to enable the rollers to yield to permit the passage of a kink or other obstruction in the log, and to permit the passage of different sizes of log. The use of a pair of mutually perpendicular sets of rollers in succession ensures that substantially the entire circumference of the log is compressed to break the bark-wood bond and also that the log is held by the rollers so that its ends do not describe an elliptical or other orbital path during debarking.

FIGS. 2 and 3 illustrate one practical arrangement that can be adopted for each pair of rollers in the equipment depicted in FIG. 2.

As shown in FIGS. 3 and 4, the rollers 30 of each pair of rollers are mounted on respective-supports 32. Each support 32 is adapted to pivot about an axle 33 that extends across the jaws at the end of a respective arm 34 (see particularly FIG. 3). The other end of each arm 34 is adapted to be rotated about an axle 35 that is mounted on the framework of the equipment. Respective hydraulic rams 36 control the movement of the arms 34 and the means whereby the rollers 30 apply pressure to the bark of a log 31 that is travelling through the debarking equipment. Each roller is driven to propel a log through the equipment.

The arrangement of two pairs of rollers, illustrated in FIG. 1, is effective for the debarking of logs having a substantially uniform cross-section with a diameter approximately equal to twice the radius of curvature of the concave shape of the rollers. However, problems arise when the logs are not essentially circular in cross-section and when the logs have large branch stubs and other irregularities which tend to block the forward movement of the log through the rollers.

To avoid these problems, it is preferred to provide three pairs of rollers, mounted in spaced apart relationship in the direction of travel of a log through the debarking equipment, as shown in schematic form in FIG. 4.

FIG. 4 comprises both a top view (a) and an end view (b) of a log 51 passing through three pairs of rollers 52, 53 and 54. The axes of rotation of each pair of rollers are substantially parallel to each other and at an angle of substantially 60° relative to the axes of rotation of the rollers in each other pair of rollers. Unless separate bark cutting means are provided, each of the six rollers in this embodiment will have respective blades attached to or formed on their outer surfaces. The operation of debarking equipment which includes a roller assembly as illustrated in FIG. 4 will be evident to persons skilled in this art from the above discussion of the FIG. 2 embodiment, and of the roller mounting arrangement of FIGS. 2 and 3.

All of the embodiments described above are particularly suitable for use with Eucalypt logs having stringy bark which are difficult to de-bark with existing techniques, but the present invention is not limited to the debarking of logs of this type. It is equally useful for debarking logs of other timber species.

We claim:

1. Apparatus for removing bark from a log comprising:

(a) at least two pairs of rollers, each roller having a concave outer surface support means for mounting the rollers of each pair of rollers for rotation about respective axes of rotation disposed parallel to each other and spaced apart laterally at an angle relative to the axes of rotation of each other pair of rollers; each pair of rollers defining an aperture through which a log may pass, each said aperture being located on a linear path for said log through the apparatus;

(b) respective biasing means operatively connected to each pair of rollers for resiliently biasing at least one roller of each pair of rollers towards the other roller in its pair of rollers to apply pressure to the bark of the log; and (c) cutting means for cutting through the bark during the passage of the log between the pairs of rollers.

2. Apparatus as defined in claim 1, in which each roller is mounted on a respective roller support means and said biasing means comprises a respective hydraulic ram connecting each roller support means to a frame of said apparatus.

3. Apparatus as defined in claim 1, in which the concave surface of at least each roller of the first pair of rollers encountered by the log as it enters the apparatus is provided with means to grip the log.

4. Apparatus as defined in claim 1, comprising two pairs of rollers, with the axes of rotation of one pair of rollers being substantially at right angles to the axes of rotation of the other pair of rollers.

5. Apparatus as defined in claim 1, comprising three pairs of rollers, the axes of rotation of each pair of rollers being substantially at an angle of 60° relative to the axes of rotation of each other pair of rollers.

6. Apparatus as define in claim 4, in which each roller of the first pair of rollers encountered by the log as it passes through the apparatus has a roughened concave surface, and in which said cutting means comprises at least one knife blade on the concave surface of each roller of the second pair of rollers encountered by the log as it passes through the apparatus.

7. Apparatus as defined in claim 6, in which each knife blade is a helical knife blade.

* * * * *

UNITED STATES PATENT AND TRADEMARK OFFICE

CERTIFICATE OF CORRECTION

PATENT NO. : 4,875,511

DATED : October 24, 1989

INVENTOR(S) : Robin Wingate-Hill

It is certified that error appears in the above-identified patent and that said Letters Patent is hereby corrected as shown below:

On the title page item (19) delete "etal"

(75) Inventors: delete "Bernard M. Hadaway, Highett, both"

Signed and Sealed this

Seventh Day of January, 1992

*Attest:*

HARRY F. MANBECK, JR.

*Attesting Officer*

*Commissioner of Patents and Trademarks*